US005137251A

United States Patent [19]

Jennings

[11] Patent Number: 5,137,251

[45] Date of Patent: Aug. 11, 1992

[54] POUR WINDOW FOR A CONCRETE FORM

[75] Inventor: Bob L. Jennings, Fountain Valley, Calif.

[73] Assignee: Economy Forms Corporation, Des Moines, Iowa

[21] Appl. No.: 400,699

[22] Filed: Aug. 30, 1989

[51] Int. Cl.[5] ..... E04G 9/10; E04G 11/06

[52] U.S. Cl. ..... 249/189; 249/10; 249/17; 249/33; 249/105; 249/153; 249/155; 249/179

[58] Field of Search ..... 249/1, 10, 11, 13, 18, 249/48, 105, 153, 155, 179, 189, 17, 33; 264/32

[56] References Cited

U.S. PATENT DOCUMENTS

| | | | |
|---|---|---|---|
| 1,965,319 | 7/1934 | Romero | 249/33 |
| 4,679,763 | 7/1987 | Brotherton | 249/189 |
| 4,804,320 | 2/1989 | Sommer et al. | 249/20 |

OTHER PUBLICATIONS

Economy Forms Corp., Des Moines, Iowa, Blueprints ST-357, p. 9, and ST-358, p. 53, RedI-Radius Form W Pour Window.

*Primary Examiner*—James C. Housel
*Attorney, Agent, or Firm*—Kent A. Herink; Brian J. Laurenzo

[57] ABSTRACT

A pour window for a metal concrete form flexible to a predetermined arcuate shape. A window panel of a generally rectangular shape forms part of a door which is pivotally mounted at one edge thereof for movement between an open and a closed position thereof. In the open position, concrete can be poured inside assembled forms intermediate the outside edges of the form assembly. In the closed position secured to structural members of the form, the window panel conforms to the generally arcuate shape of the form to present a substantially continuous arcuate surface for the forming of curvital concrete surfaces.

4 Claims, 2 Drawing Sheets

POUR WINDOW FOR A CONCRETE FORM

BACKGROUND OF THE INVENTION

The invention relates generally to prefabricated metal concrete construction forms and, more specifically, to a pour window formed in a prefabricated concrete construction form for the construction of curvital or planar concrete surfaces.

Concrete construction forms are generally prefabricated by the manufacturer for use in a particular application, such as corner forms, linear wall forms, or form parts for assembly on the job to form structures having a curved surface and the like. A concrete construction form that is transportable as a unit and adjustable for use in the construction of concrete structures having a planar or curved surface, or a combination of such surfaces, is described in U.S. Pat. No. 4,679,763. Such forms are assembled edge-to-edge and used in combination in a slip-forming operation to form wall structures wherein the assembly is moved in either a vertical or horizontal direction. When forming walls in the horizontal direction, two or more forms may be stacked vertically and moved as a unit. The vertical height of the forms may exceed that which can be efficiently or conveniently poured from the top of the combination of forms. It is, accordingly, preferred that means be provided for introducing concrete into the wall-forming void at points intermediate the height of the combination of forms.

SUMMARY OF THE INVENTION

The invention provides a pour window opening and an associated door for a prefabricated concrete construction form to permit the introduction of concrete into the wall-forming void between spaced-apart opposing forms. The form has a flexible metal panel member with an integral perimeter flange and a plurality of longitudinal and transversely spaced-apart brace members projected laterally from one side. A pair of transversely opposite side sections of the perimeter flange are divided into a plurality of segments by longitudinally spaced V-shaped notches, the apices of which are adjacent the one side of the panel member to provide for a lateral flexing movement of the panel member to a desired curved shape. The segments of each of the flange side sections are rigidly but releasably connected together against relative movement by a retaining or tension strap to maintain a preselected curved shape of the flexible panel member.

Two rows of a plurality of transversely opposite intermediate flange segments project laterally from the on side of the panel member and are arranged in a parallel spaced relation relative to and between the opposite side sections of the perimeter flange. The intermediate flange segments are connected together by a tension strap as described previously to maintain a preselected curved shape of the flexible panel member. A square or rectangular portion of the panel member located between the rows of the intermediate flange segments and of a width extending from one of the brace members to a second adjacent brace member is removed, along with the included section of the first adjacent brace member, to form a pour window. A pour window door is mounted on the on brace member by a piano hinge for opening movement to the on side of the panel member. The door is moved to the closed position and then releasably secured to the intermediate flange segments and to the second adjacent brace member to conform to the shape of the panel member so that the panel member is substantially smooth and continuous over its entire surface.

DETAILED DESCRIPTION OF PREFERRED EMBODIMENT

Figures 1, 2:
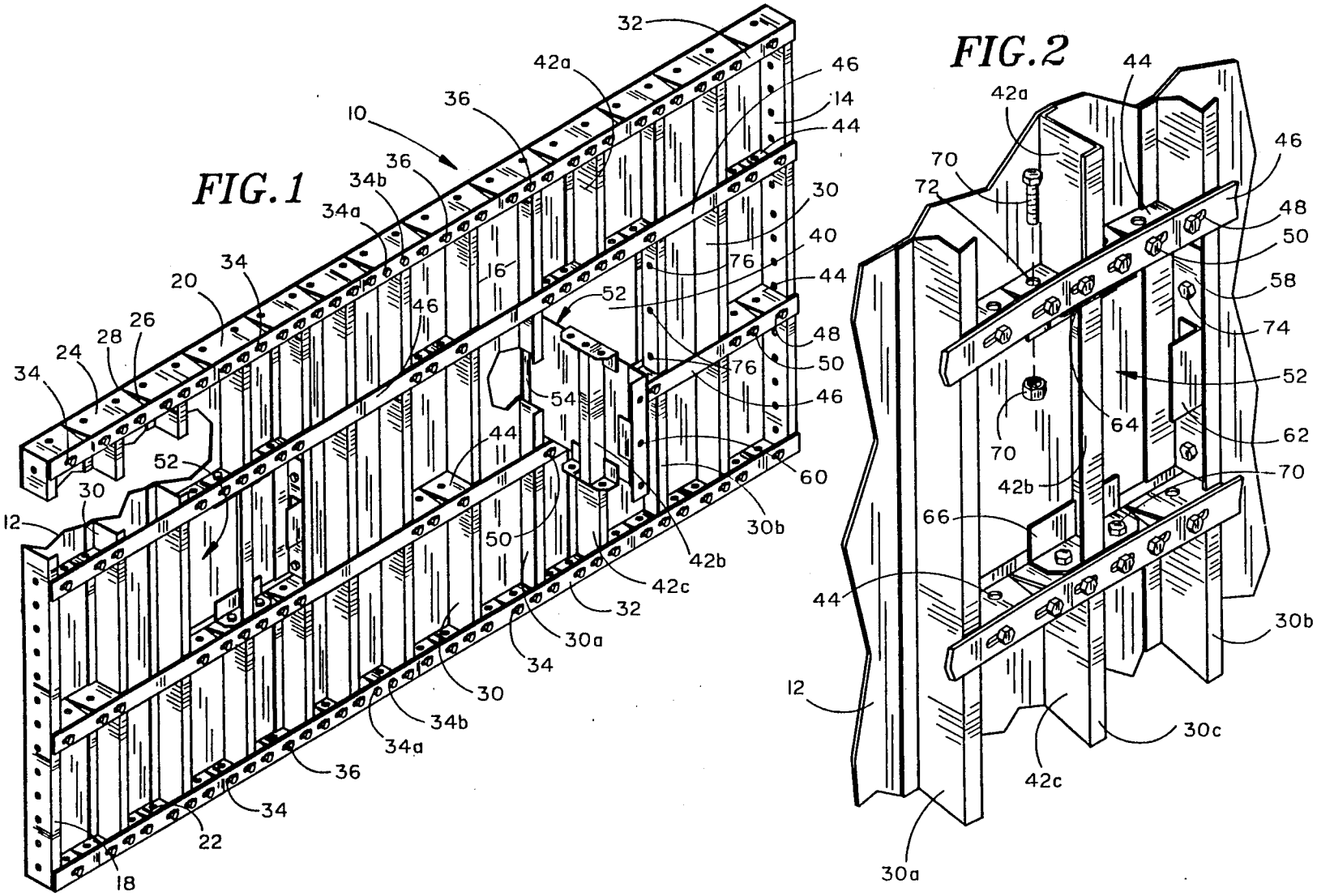
FIG. 1 is a rear perspective view of a metal concrete form illustrating one closed and one open pour window door of the present invention, with parts removed for clarity.
FIG. 2 is an enlarged detail perspective view of the closed pour window door of FIG. 1.

Referring to FIG. 1 of the drawings, there is shown a metal concrete form 10 of a generally pan shape having a panel member 12 with a peripheral flange 14 projected laterally from one side 16 thereof. The flange 14 has a terminal flat surface portion or projection 18 in a parallel relation with the panel member 12. A pair of transversely opposite side members 20 and 22 of the flange 14 extend across the upper and lower edges, respectively, of the panel 12. A plurality of forms 10 may be assembled together by arranging the forms in a side-by-side and/or stacked relation and then bolting adjacent forms together through aligned holes or openings in the laterally projected portions of the peripheral flange 14.

For the purpose of converting the form 10 to on-site use in the construction of concrete structures having either planar or arcuate surfaces, each of the side members 20 and 22 is divided into a plurality of segments 24 by V-shaped notches 26 having their apices 28 adjacent the one side 16 of the panel member 12. The panel member 12 is formed from a sheet steel material so as to be flexible laterally of the form 10 at the notches 26 from the planar condition-illustrated in FIG. 1 to the curved condition illustrated in FIGS. 4, 5, and 6. The form 10 can also be flexed to reversely curved conditions from that illustrated in FIGS. 4, 5, and 6. A plurality of brace members or ribs 30 are spaced longitudinally of the flange side members 20 and 22 and extend therebetween in a parallel spaced relation, with each brace member 30 being secured as by weldments to the one side 16 of the panel member 12. The brace members 30 are of a substantially Z-shape in transverse cross-section (FIG. 2) and of a width substantially equal to the height of the flanges 14.

The planar or arcuate shape of the panel member 12 is maintained by a tension strap member 32 formed with longitudinally spaced openings 34 for alignment with associated holes (not shown) in the segments 24 of the flange side members 20 and 24. Bolt assemblies 36 insertable through the aligned ones of the holes in the segments 24 and openings 34 on being tightened lock the segments in each flange side member 20 and 22 against relative movement whereby to maintain the planar (FIG. 1) or flexed arcuate condition (FIGS. 4, 5, and 6) of the panel member 12.

As disclosed fully in U.S. Pat. No. 4,679,763, which is incorporated herein by this reference, tension members 32 are released from their segment locking position by loosening of the bolt assemblies 36 to permit adjustable flexing of the panel member 12 and repositioning of the tension members 32 relative to the segments 24 of the flange side members 20 and 22. Flexing of the panel member to a preselected arcuate shape is easily accomplished by overlying the panel member atop a fixture or jig constructed to have the preselected arcuate shape. The openings 34 in the tension members 32 are of an elongated shape in a direction longitudinally of the tension member except for a pair of openings 34*a* and 34*b* that are located centrally of the tension member. After the panel member 12 has been flexed to conform to the desired shape, the bolt assemblies 36 are tightened as described above. As thus far described, the metal concrete form 10 is commercially available for forming planar or arcuate surfaces of concrete structures.

For the purpose of providing a form 10 which will permit the introduction of concrete to the space between wall forming form assemblies, a pair of rectangular pour window openings, one of which is illustrated in open position in FIG. 1 at 40, are made in the panel member 12 of a form 10. The pour window opening 40 extends from one of the brace member 30*a* to a second adjacent brace member 30*b* with the result that the intervening or first adjacent brace member 30*c* is divided into three foreshortened sections, namely an upper section 42*a*, a middle or door section 42*b*, and a lower section 42*c*.

A pair of rows of intermediate flange segments 44 project laterally from the one side 16 of the panel member 12 between adjacent brace members 30 and are attached to the panel member 12 as by weldments. Each row of intermediate flange segments 44 is substantially identical to the segments 22 of the side members 20 and 24 except that they do not extend continuously transversely across the form 10, but are arranged in a group between selected brace members 30 and in a linear relation parallel with and between the flange side members 20 and 22 and are adjacent to the top and bottom edges of the pour window opening 40. A tension member 46 with openings 48 is attached to the intermediate flange segments 44 by bolt assemblies 50 inserted into associated and aligned holes (not shown) of the flange segments 44 in the same manner as previously discussed for the tension member 32 and flange segments 24. Accordingly, the tension members 46 and intermediate flange sections 44 serve further to lock the form 10 into the preselected shape therefor.

Figure 3:
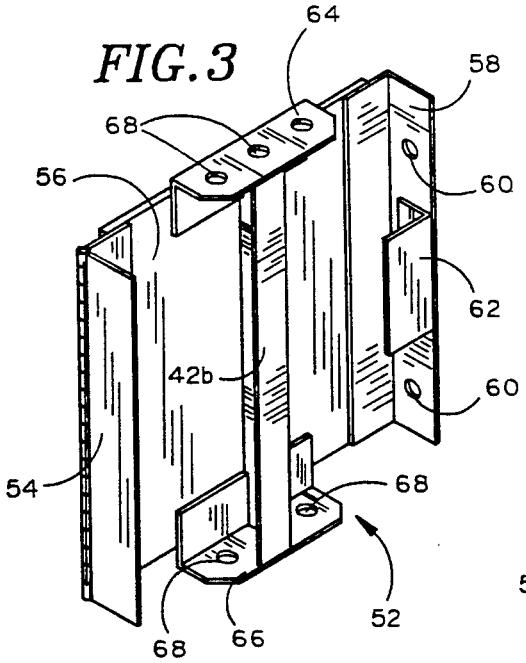
FIG. 3 is an enlarged rear perspective view of a pour window door removed from the form.
Figure 6:
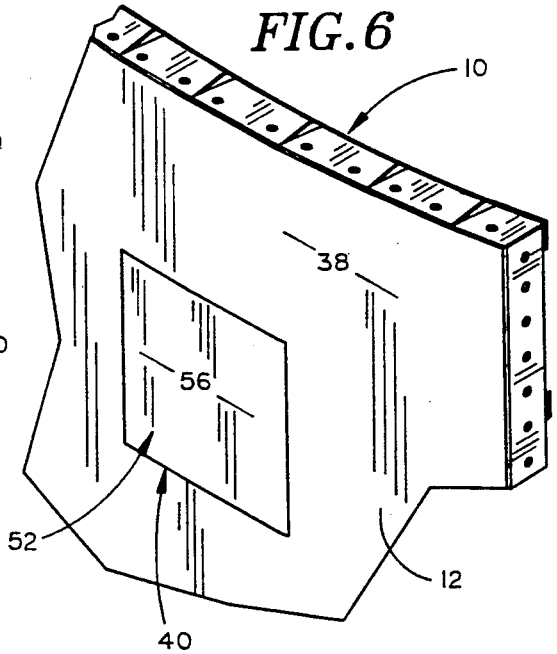
FIG. 6 is a fragmentary front perspective of the form of FIG. 5 showing the door in the fully closed position to form a continuous surface with the form panel member.

A flexible pour window panel or door 52 constructed from the sheet material of the frame panel member 12 is mounted on the brace member 30*a* for pivotal movement between an open position (illustrated at the right in FIG. 1) and a closed position (illustrated at the left in FIG. 1) relative the pour window opening 40 by means of a piano hinge 54 (FIGS. 1 and 3), which is attached to the brace member 30*a* and door 52 by weldments or the like. When the door 52 (FIG. 3) is in the closed position it will fill the pour window opening 40 of the panel member 12, as best illustrated in FIG. 6, to form a continuous surface with the other side of 38 of the panel member 12. At the free end portion of the door 52 is located a door closure flange 58 which extends laterally of the door or window panel section 52 and includes three holes 60 (one not shown in FIG. 3) for use in locking the door 52 in the closed position therefor as will be described below. Extended inwardly from the upper or free edge of the door closure flange 58 is a handle member 62 to assist in pivotally moving the door 52.

An upper and lower closure flange 64 and 66 are attached at the upper and lower edges, respectively, of the door 52 with each having three holes or openings 68 that correspond to and may be aligned with openings 72 of the intermediate flange segments 44 (FIG. 2). Bolt assemblies 70 are inserted in the aligned holes 68 and 72 and tightened to secure the door 52 to the intermediate flange segments 44. Likewise, bolt assemblies 74 are used to lock the door closure flange 58 to the brace member 30*b* through the aligned holes 60 in the closure flange 58 and corresponding openings 76 in the brace member 30*b* (FIG. 1).

The door 52 (FIG. 3) is completed by the intermediate brace member section 42*b* which acts as a stiffening member and is secured by weldments or the like to the door or window panel section 56 and extends between the upper and lower closure flanges 64 and 66. The brace member sections 42*a–c* are of a Z-shape in transverse cross-section, as are all of the other brace members 30. However, brace member sections 42*a–c* are reversed so that the outer or free leg portions thereof extend in a direction opposite to that of the other brace members 30 (FIG. 2). Reversal of the brace member sections 42*a–c* serves to strengthen the assembly of the door 52 with the form 10.

Figure 4:
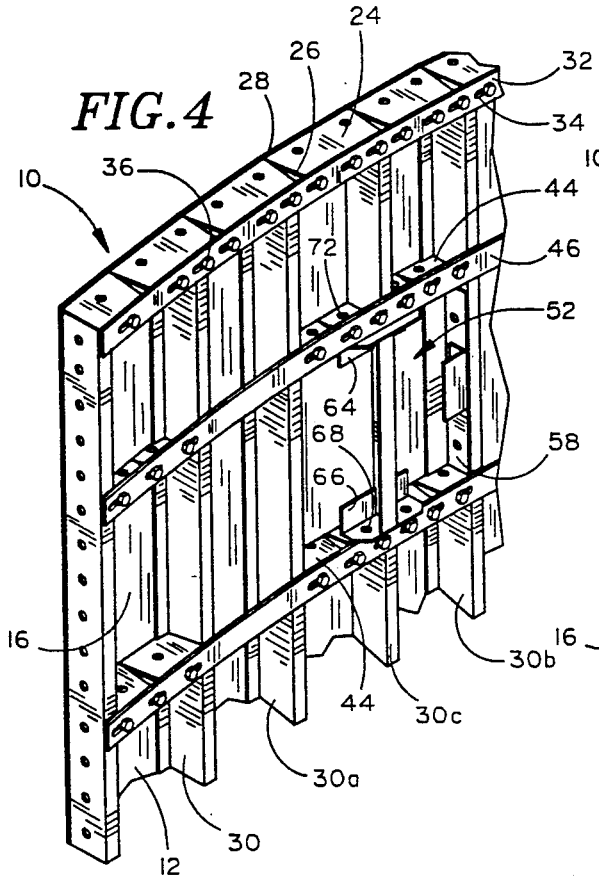
FIG. 4 is a partial rear perspective view of a form curved for forming a wall having a curved surface and illustrating a pour window door in a partially closed position.
Figure 5:
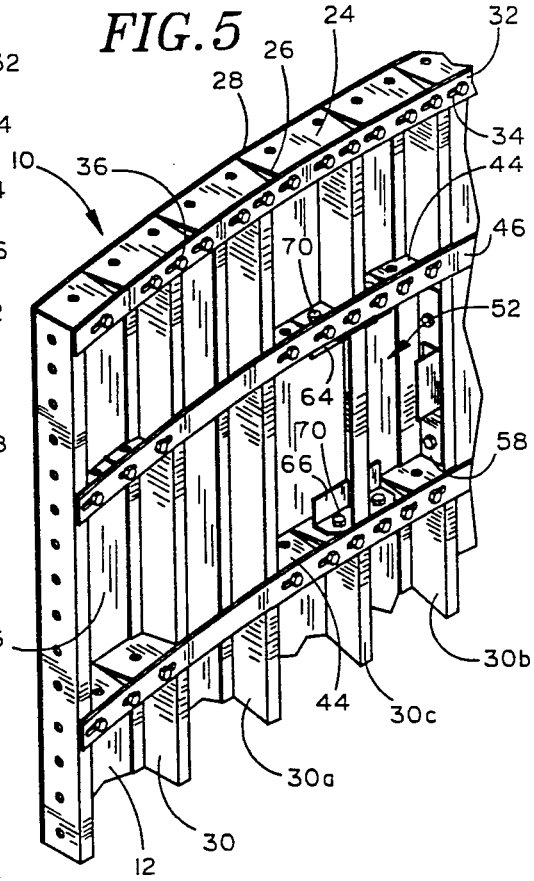
FIG. 5 is illustrated similarly to FIG. 4 and shows the door in a fully closed position and secured to the curved form.

In FIG. 4, the form 10 is of an arcuate shape and the door 52 is closed but unsecured to the intermediate flange segments 44 or to the brace member 30*b* and so is substantially planar. In FIG. 5, pressure has been exerted on the door 52 to flex it in conformance with the arcuate shape of the panel member 12 of the form 10. The holes 60 and 76 (FIG. 1) and the holes 68 and 72 are aligned by a drift pin or similar tool. Bolt assemblies 74 are then inserted through aligned holes 60 and 76 and tightened to secure the closure flange 58 to the brace 30*b*. Similarly, the bolt assemblies 70 are inserted through aligned holes 68 and 72 and tightened to secure the locking flanges 64 and 66 to the flange segments 44. The panel section 56 of the door 52 in the closed and locked position will conform to the arcuate shape of the form 10 to provide a continuous surface for the forming of a smooth and arcuate concrete surface (FIG. 6) on the finished concrete wall structure.

Although the invention has been described with respect to a preferred embodiment thereof, it is to be understood that it is not to be so limited since changes and modifications can be made therein that are within the full intended scope of this invention as described in the following claims.

I claim:

1. A concrete form having a flexible panel member with an upstanding peripheral flange projected laterally from one side thereof and a plurality of longitudinally spaced brace members extended between and connected to a pair of transversely opposite side sections of said peripheral flange with each of said side sections being of an articulated construction to provide for said panel member being flexible in a direction laterally of said brace members to a preselected arcuate shape, and pour window means for said form to permit the introduction of concrete through said panel member, said pour window means comprising:

(a) a flexible window panel of a generally rectangular shape;

(b) said panel member having a window opening therein located between a selected one of the brace members and a second adjacent brace member and of a size and shape to receive said window panel to form a continuous surface with said panel member when in a closed position therefor;

(c) a first adjacent brace member located between said selected brace member and said second adjacent brace member;

(d) a stiffening member secured to said window panel and extended longitudinally of said first adjacent brace member, whereby the window panel in the open position therefor is flexibly movable as a unit with the panel member to the closed position corresponding to the arcuate shape of the panel member;

(e) means pivotally supporting said window panel on said selected one brace member for movement into and out of the closed position for said window opening;

(f) means for releasably locking said window panel with the panel member in the closed position; and (g) means releasably retaining said window panel and panel member as a unit in said arcuate shape.

2. The form of claim 1, wherein:

a. the first adjacent one of said brace members is comprised of a pair of end sections spaced apart a distance substantially equal to the transverse dimension of said window opening therebetween;

b. said window opening having a longitudinal dimension substantially equal to the distance between said selected one of the brace members and said second adjacent brace member; and c. said releasable retaining means includes said stiffening member secured to said window panel.

3. The form of claim 2, wherein:

said releasable retaining means includes means for releasably locking the opposite side of said window panel to the second adjacent brace member; and means for securing said stiffening member to the end sections of said first adjacent brace member.

4. The form of claim 3, wherein:

a. on release of said releasable locking means and stiffening member securing means, said window panel is movable on the pivotal support means to the open position.

* * * * *